US006427494B1

(12) United States Patent
Monteiro

(10) Patent No.: US 6,427,494 B1
(45) Date of Patent: Aug. 6, 2002

(54) INTRODUCED IN WASHING MACHINES

(75) Inventor: Marcelo Monteiro, São Paulo (BR)

(73) Assignee: Ricardo Mondella (BR)

( * ) Notice: Subject to any disclaimer, the term of this patent is extended or adjusted under 35 U.S.C. 154(b) by 0 days.

(21) Appl. No.: 09/554,228

(22) PCT Filed: Nov. 13, 1998

(86) PCT No.: PCT/BR98/00091

§ 371 (c)(1),
(2), (4) Date: Sep. 18, 2000

(87) PCT Pub. No.: WO99/25914

PCT Pub. Date: May 27, 1999

(30) Foreign Application Priority Data

Nov. 13, 1997 (BR) ..... 9705847
Nov. 13, 1998 (BR) ..... 003907

(51) Int. Cl.[7] ..... D06F 37/30
(52) U.S. Cl. ..... 68/20; 68/140
(58) Field of Search ..... 68/19.2, 24, 25, 68/140, 5 C, 20

(56) References Cited

U.S. PATENT DOCUMENTS 2,171,499 A * 8/1939 Busi ..... 68/25
4,114,406 A * 9/1978 Horowitz et al. ..... 68/24
5,000,015 A * 3/1991 Nakamura et al. ..... 68/25 X

FOREIGN PATENT DOCUMENTS

FR 991823 * 6/1951 ..... 68/140

* cited by examiner

*Primary Examiner*—Philip Coe
(74) *Attorney, Agent, or Firm*—Cantor Colburn LLP

(57) ABSTRACT

Improvements introduced in washing machines which allow that the tilting of the two-way washing chamber is carried out mechanically by a set of linked gears or electrically carried out by using three electrical motors, one motor to carry out the 360° turn around an "X" axis, and the two other motors to carry out the 360° turn around a "Y" axis, in this case, the second and third motors are supported on an arc which sustains the washing chamber, fixed at the height of the middle point of the aforesaid chamber; another way to carrying out the tilting of the washing chamber consists in providing two motors, one motor to carry out the 360° turn around an "X" axis, and another motor to carry out the 360° turn around a "Y" axis, using, in this case, the very surface of the washing chamber so as to fix on it a constituent part of the second motor; the two-way washing chamber presents a spherical format and one or more caps can be removed from it.

11 Claims, 9 Drawing Sheets

INTRODUCED IN WASHING MACHINES

TECHNICAL FIELD

According to the state of art, the washing machines, also known as clothes washers, are basically characterized by the fact of speeding up the clothes washing process by means of the friction produced by the motion which arises inside the washing chamber (tank).

BACKGROUND OF THE INVENTION

Many washing machines and washing systems are available. As a rule, there are two outstanding systems: the tilting system; and the churning system.

In their basic embodiment, conventional washing machines use water or water steam (which is considered a universal solvent), and a chemical agent, which will make the dirt removal easier, such as: powder soap among others.

As already informed, in the tilting system, the clothes are put inside the tank (or washing chamber) horizontally arranged, which receives the circular motion of the motor by means of a belt and pulley and rotates 360° around a axis the mixture water, clothes and chemical agent, follows the circular motion of the tank until the upper part of the aforesaid tank is reached, afterwards, the mixture falls down, pushed downwards by the gravity force, furthering the collision and the friction of the mixture of water and clothes with the surface of the tank, thus enabling the dirt removal.

According to this concept, the clothes are not totally immersed and, thus, require less water as compared with the churning washing system, wherein the clothes are totally immersed, the access to the clothes is through the front part of the machine (cover), therefore the user must stoop, which constitutes an ergonomic problem.

In some washing machines which carry out the tilting washing system, the water is superseded by water steam and the powder soap is superseded by other chemical agents among them, percloretilene, Dry Par, Acqua Clean.

In the churning washing, the mixture water, clothes inside the tank, moves brought by the alternated horizontal motion of the axis with the blades, located at the center of the tank itself.

Thus, the alternated motion of the aforesaid axis with the blades inside the tank is the element responsible for the friction between the water and the clothes and, as a result, for the dirt removal; however, the direct contact between the axis and the blades reduces the useful life of cloth.

In this concept, the clothes are totally immersed, making the water consumption comparatively larger, in addition to the fact that the motor is constantly used so as to enable the alternated horizontal motion of the axis with the blades, thus increasing the amperage and the electricity consumption; in this system, the access to the clothes (cover) is through the upper part of the machine, which is much better from an ergonomic point of view.

In the so-called churning system machines, the building-up of clothes in the lower and upper part of the washing chamber is almost unchanged, which permits a first-rate washing.

This is the basic embodiment of the two most outstanding systems of washing machines.

SUMMARY OF THE INVENTION

The present patent is changing in-depth the concept of the conventional washing machines, because they prefer, in substitution to the usual cylindric tanks (or washing chamber), a spherical tank (or washing chamber), from which one or more hub caps can be extracted, which carries out the tilting washing of the clothes, but forth and back, in other words, the washing chamber is forced to rotate in 360° both ways at the same time.

There are many operational technical advantages in relation to conventional washing machines.

Among the advantages, we can mention the speeding-up of the washing process and thus the saving of water and electricity, due to the fact that the washing and rinsing are carried out both ways, which originates a stronger friction between the clothes and the water, whereas the centrifugation is carried out around a unique axis.

Another advantage consists in a more effective and efficient washing, if compared to the washing of the machines which use the churning system and the one-way tilting system.

Another advantage, a constructive one, consists in the fact that the access to the clothes (cover) can be through the front part or through the upper part of the machine; besides, the spherical anatomy of the tank enables the self-arrangement of the clothes, making easier the toe-in of the machine as well as its suspension.

All these advantages arise from a totally new concept, according which the tilting of the spherical washing chamber is carried out both ways, in other words, around two axes at the same time.

It must be pointed out that only the tank rotates 360°, while the clothes upon reaching the upper part of the tank falls again.

So as to obtain the 360-degree turn of the tank around two axes at the same time, some mechanical solutions have been foreseen, among them a set of gears linked to the motor which reproduces the 360-degree turn around a first axis and another set of gears linked to the tank which changes and carries out a 360-degree turn around a second axis.

BRIEF DESCRIPTION OF THE DRAWINGS

The present invention will now be described by way of example with reference to the attached drawings, in which.

DETAILED DESCRIPTION OF THE INVENTION

Figure 1:
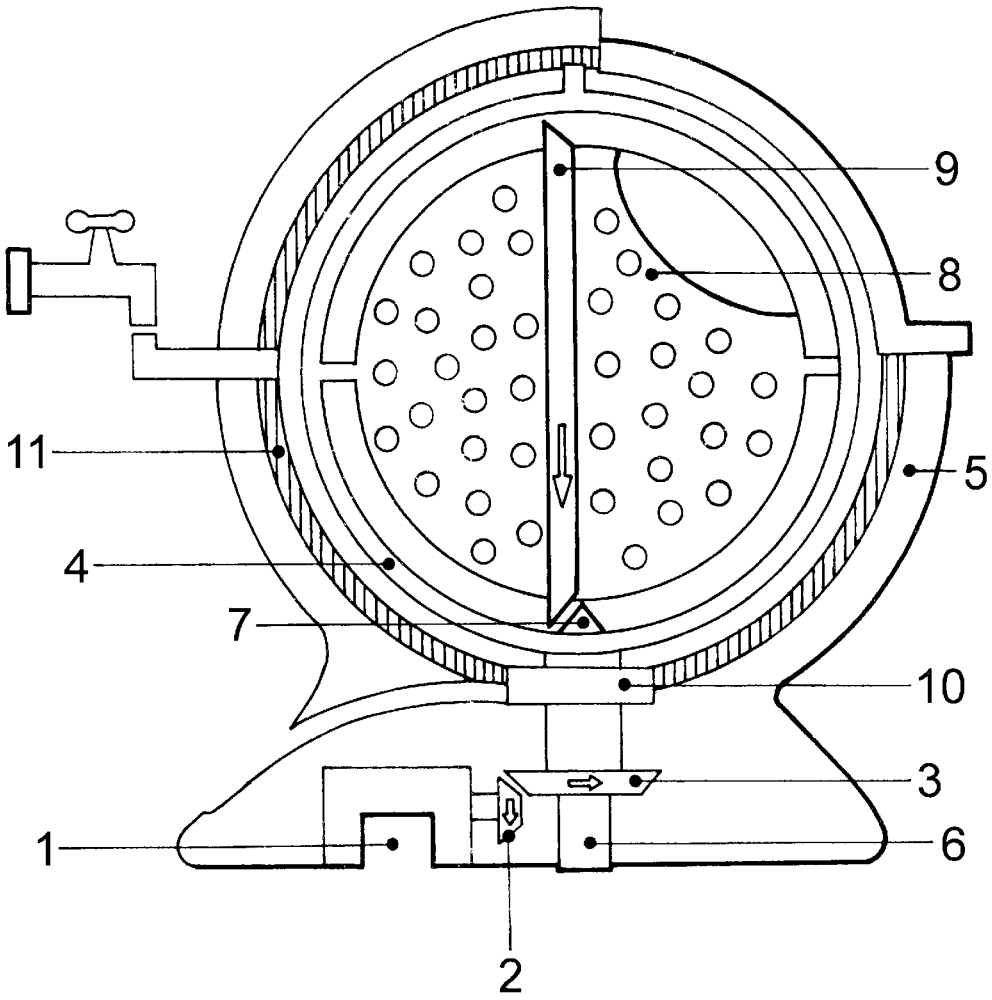
FIG. 1 schematically shows a washing machine including linked sets of gears.

FIG. 1 shows these linked sets of gears while carrying out the 360-degree turn of the tank both way. In order to do so, there is an electrical motor (1) provided, at its end, with a driving pinion (2) of the gear (3), which is connected to the arc (4) supported on the structure (5) of the machine. To this structure is attached an axis (6) provided, at its end, with a gear (7) which passes through the gear (3); this arc (4) shows, supported on its middle point, spherical chamber (8), holed, wrapped by a toothed rack (9) which surrounds it totally; gear (3) gear receives the circular motion of the motor (1), permitting a 360-degree turn of the spherical chamber (8), around the axis (6) fixed to the structure of the machine; the toothed rack (9) which wraps the body of the spherical chamber (8), in contact with the gear (7) of the axis (6), gives rise to a 360-degree turn of the spherical chamber (8) vertically; there is a draining ring (10) to let the water out during the centrifugation which is carried out only horizontally; there is also a hot chamber (11) for the steam injection or hot air during the drying process.

Figure 2:
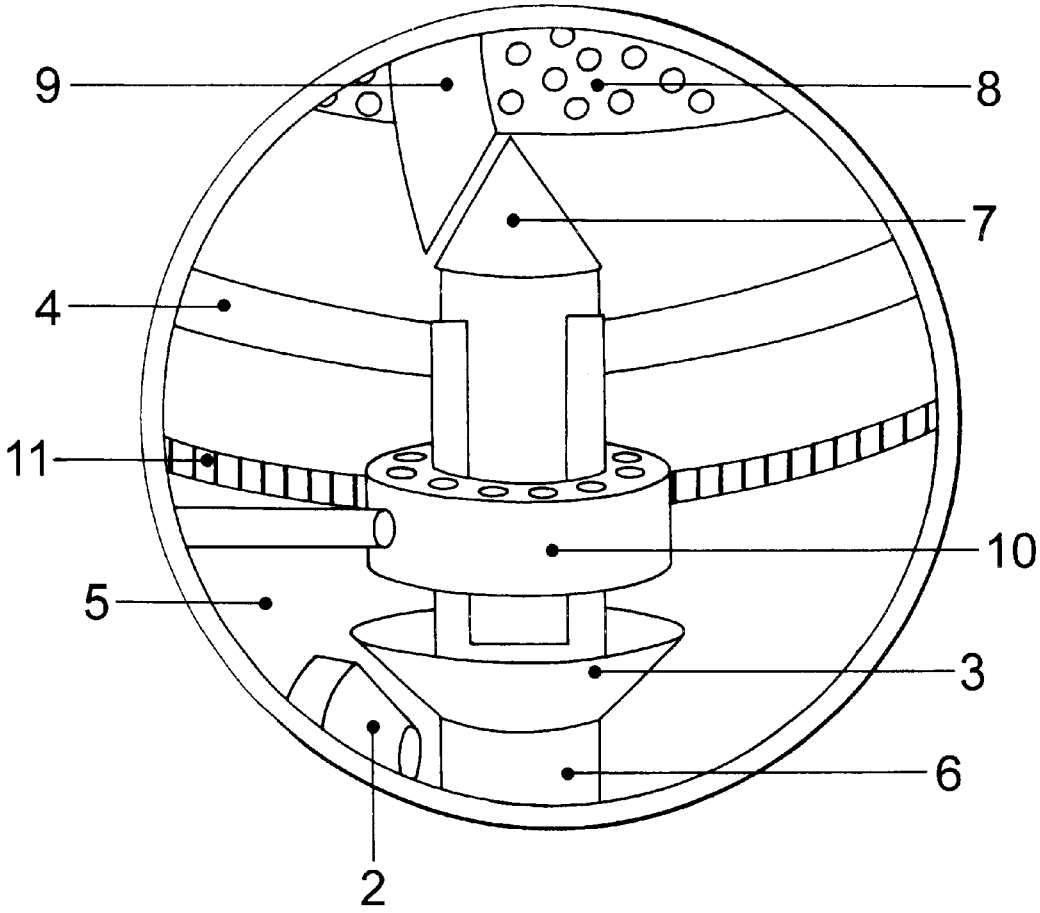
FIG. 2 shows a transmission mechanism and a motion conversion in the washing machine of FIG. 1.

FIG. 2 shows in details the transmission mechanism and the motion conversion made up by a pinion (2), a gear (3), which is connected to an arc (4), which is supported on the structure (5) of the machine; to this structure (5) an axis (6) is fixed, which presents at its end a gear (7) which passes through the gear (3) and touches the toothed rack (9) which wraps the spherical washing chamber (8), together with the draining ring (10) and the hot chamber (11).

Figure 3:
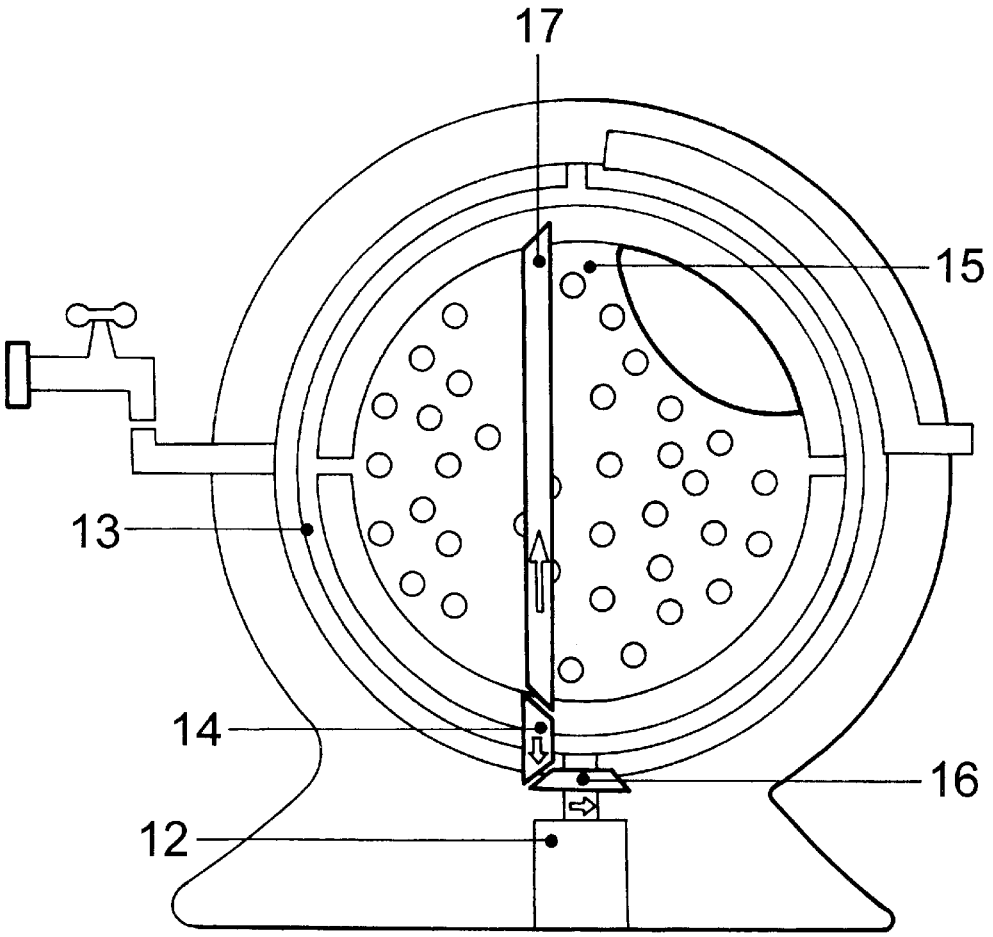
FIG. 3 shows an alternative form of the washing machine shown in FIG. 1.

FIG. 3 shows another mechanical form to carry out the turn of the washing chamber both ways. In order to so, there is an electrical motor (12) which causes the 360-degree turn of an arc (13) around its own axis, where there is a gear or friction wheel (14) which is in contact with the spherical chamber (15); there are also a toothed rack (16), fixed to the base of the machine, as well as a toothed rack (17) which totally wraps the spherical chamber (15); the arc (13) rotates horizontally 360° around its axis, causing the 360-degree turn of the gear or friction wheel (14) vertically; which is free, in contact with the toothed rack (16) fixed at the base of the machine; the horizontal circular motion of the arc (13) is converted into vertical circular motion of the spherical chamber (15), through the contact of the free friction wheel (14)with the fixed toothed rack (16); this vertical circular motion passes to the spherical chamber (15)by means of the toothed rack (17)which totally wraps the aforesaid chamber (15).

So as to carry out the tilting of the washing chamber both ways at the same time in an easier way, other forms have been developed. One of these forms consists in the use of three electrical motors, one to carry out the 360-degree turn around an "X" axis and two others to carry out the 360-degree turn around a "Y" axis; in this case, the second and third motors are supported on the arc which upholds the washing chamber, fixed at the height of the middle point of the aforesaid chamber.

Another form to carry out the tilting of the washing chamber consists in using two motors, one which carries out the 360-degree turn around an "X" axis and another motor which carries out the 360-degree turn around a "Y" axis; in this case, the very surface of the washing tank is used so as to fix on it a constituent part of the second engine; thus, this second motor consists of a belt or ring of inducers wrapped in plastic and fixed on the middle point of the tank surface so as to insulate the current; the other part of the motor, made up of another ring of inducers insulated from the water contact, is coupled to the inner surface of the sustainment arc; the aforesaid sustentation arc encompasses the whole tank, and, thus, the belt or ring of inducers in its middle point; thus an electrical current is induced so as to generate a magnetic field which carries out the 360-degree turn around the second axis.

Thus,the first motor makes the arc which sustains the washing tank rotate 360° around the "X" axis, and the second engine, now with a part integrated to the tank surface, makes the tank rotate 360° around the "Y" axis.

This set of innovations is likely to make the construction of the machine easier by reducing the number of parts, components, as well as making effectively more concrete the viability of the new concept.

On the other hand, this set of innovations is also applied to conventional one-way tilting washing machines (horizontal cylindric tanks), wherein the circular motion of the motor is transmitted to the washing tank by means of a belt and pulley, as well as to conventional churning-system washing machines (vertical cylindric tanks), wherein there is the alternated motion of the axis with the blades during the washing process, and the circular motion of the tank, in a unique way during the centrifugation process, requiring, in this case, a transmission. By applying the innovations which have been developed to the conventional washing machines, these machines will be more compact, lighter, much more simple, both from the constructive and operational point of view.

Furthermore, it is also due to the use of these innovations in conventional machines that quite an import application is obtained. In the simple tilting with spherical washing chamber, new anatomy of the tank which enables its tilting, preferably around 45°, without any increase in the total volume of the washing machine; this enables a better arrangement and a more homogeneous distribution of the clothes inside the spherical tank, and now tilted, besides adding the ergonomic advantages of the washing machines which use the churning system, where the access to the clothes is through the upper part, to the advantages of the simple tilting washing system.

Finally, the Applicant also developed variations in the anatomy of the both-way washing chamber,which permit that one or more caps can be removed from the aforesaid spherical washing chamber.

Figure 4:
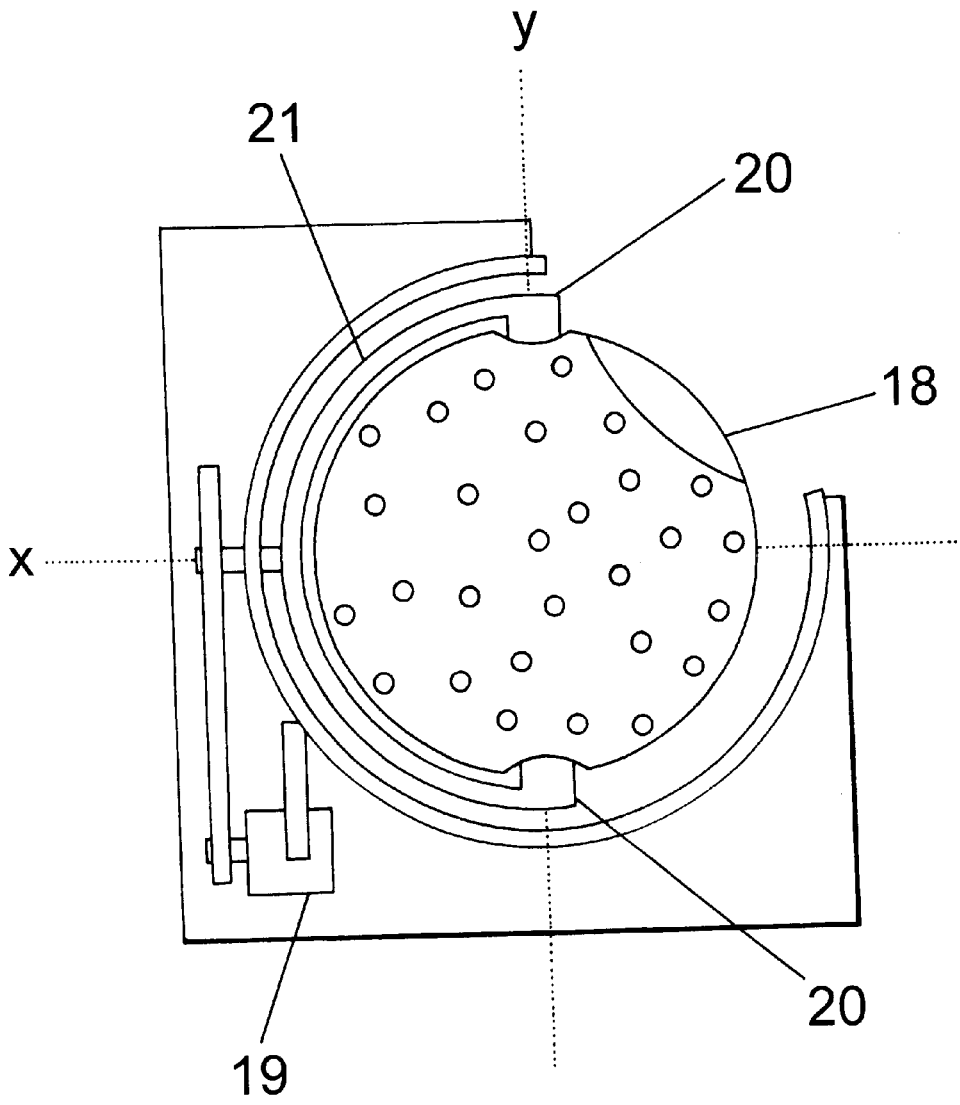
FIG. 4 shows one embodiment of the present invention showing a tilting of a washing chamber.
Figure 5:
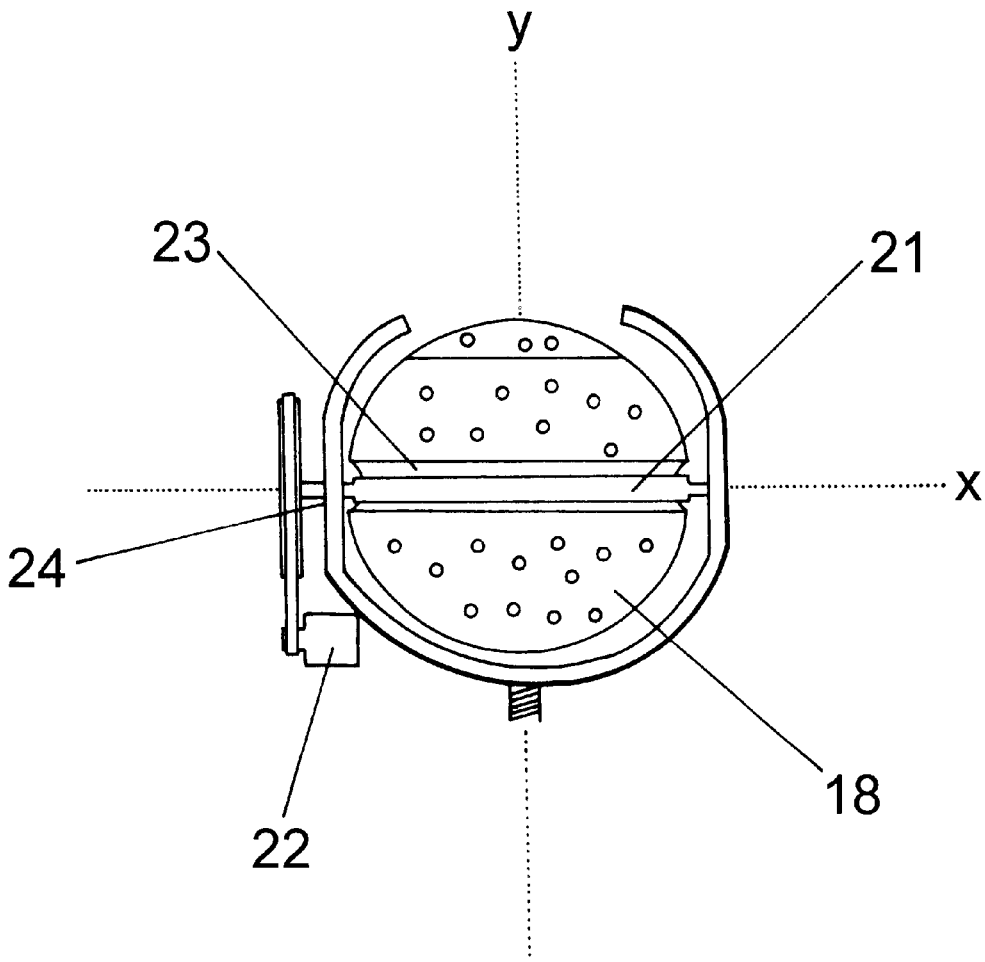
FIG. 5 shows another embodiment of the present invention showing a tilting of a washing chamber.
Figure 6:
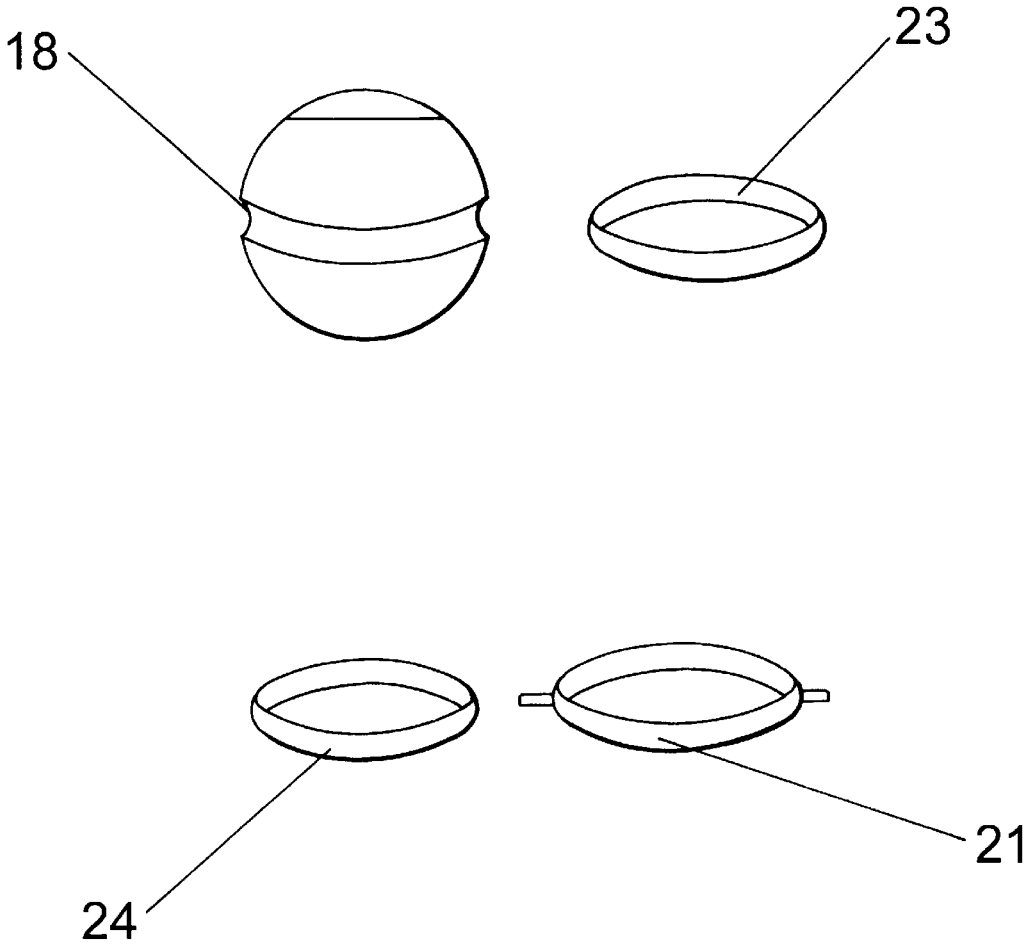
FIG. 6 shows elements of a second motor.
Figure 7:
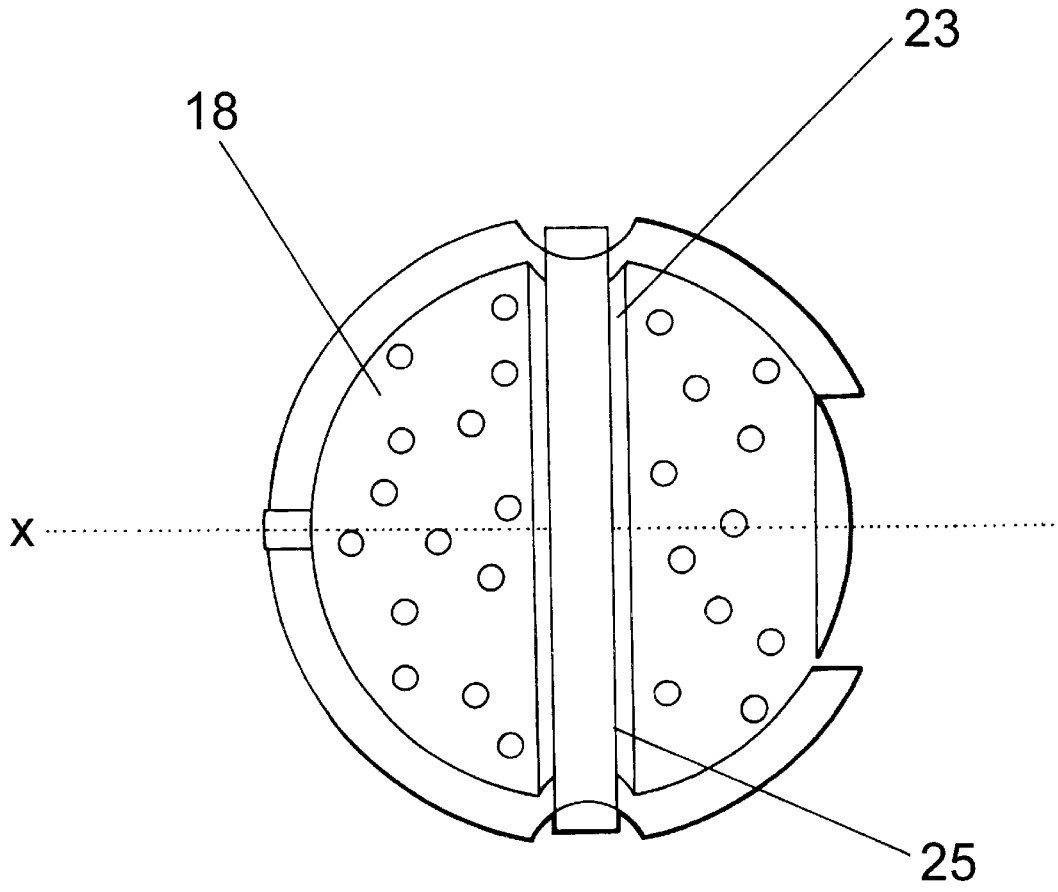
FIGS. 7 and 8 show an application of the present invention to a conventional tilting-system washing machine.
Figure 8:
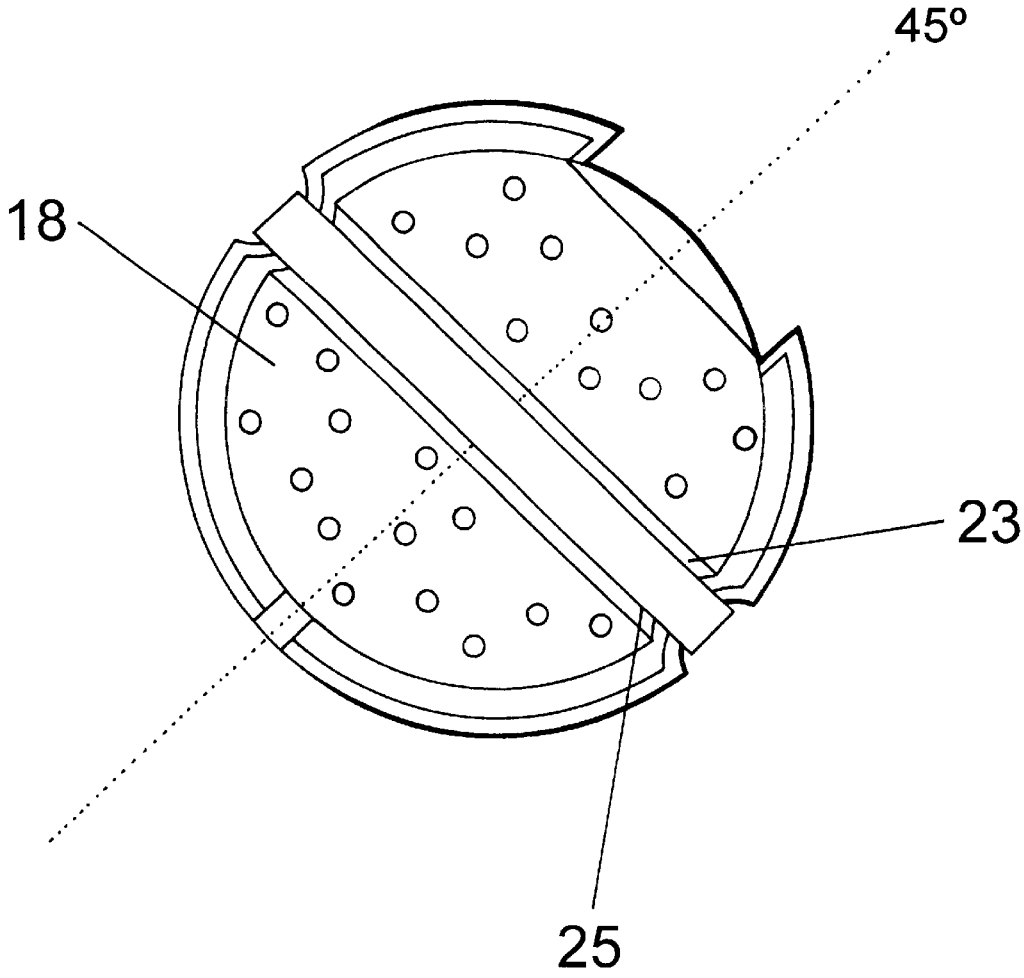
Figure 9:
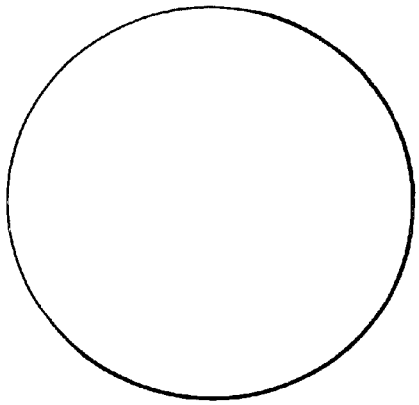
FIGS. 9–11 show various forms of a washing chamber.
Figure 10:
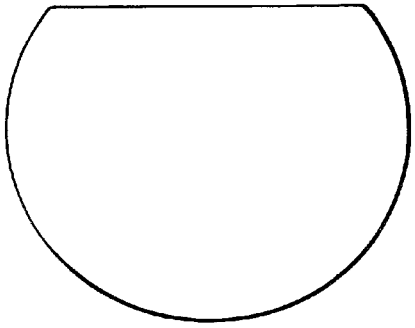
Figure 11:
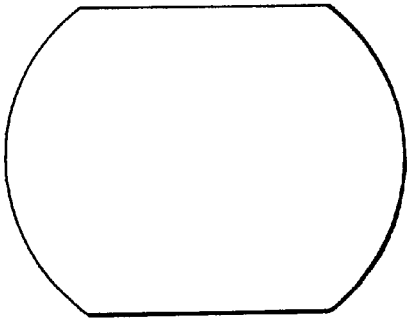

So as to better illustrate the present invention, we are annexing drawings thereof. FIG. 4 shows one of the forms to carry out the tilting of the both-way washing chamber, wherein three electrical motors are used, one to carry out the 360-degree turn around the "X" axis and two others to carry out the 360-degree turn around the "Y" axis; FIG. 5 shows another way to carry out the tilting of the both-way washing chamber, wherein two motors are used, one to carry out the 360-degree turn around the "X" axis and another one to carry out the 360-degree turn around the "Y" axis,and in this case the very surface of the washing tank is being used so as to fix on it a constituent part of the second motor; FIG. 6 shows the constituent components of the second motor; FIGS. 7 and 8 show the application of the present innovation in a conventional simple tilting-system washing machine; and FIGS. 9, 10 and 11 show possible formats for the innovated washing chamber.

In order to carry out the tilting of the both-way washing chamber (18) three electrical motors are provided, one motor (19) to carry out the 360-degree turn around an "X" axis, and two other motors (20) to carry out the 360-degree turn around the "Y" axis; in this case, the second and third motors are supported on the arc (21) which sustains the washing chamber (18), fixed at the height of the middle point of the aforesaid chamber (see FIG. 4).

Another way to carry out the tilting of the washing chamber (18) consists in providing two motors, one motor (22) to carry out the 360-degree turn around the "X" axis, and another motor to carry out the 360-degree turn around the "Y" axis, and, in this case, the very surface of the washing chamber (18) is used so as to fix on it a constituent part of the second motor; this motor is made up of a belt or ring (23) of inducers wrapped in plastic and fixed on the middle point of the tank surface in order to insulate the current; the other part of the motor, made up of another ring (24) of inducers insulated from the water contact, is coupled to the inner surface of the sustainment arc (21) of the tank, this arc emcompasses the whole tank and thus the ring or belt (23) of inducers at its middle point; thus an electrical current is induced so as to generate a magnetic field which carries out the 360-degree turn around the second axis (see FIG. 5).

Thus, the first motor (22) makes the arc (21) which sustains the washing chamber (18) rotate 360° around the "X" axis, and the second motor, now with a part integrated to the tank surface and a part integrated to the arc (21), makes the tank rotate 360° around the "Y" axis.

FIG. 6 shows the constituent components of the second motor separately.

The improvements introduced can be also applied to simple tilting-system washing machines, as shown in FIGS. 7 and 8; FIGS. 7 shows that the access to the washing chamber (18) is through the front part of the washing machine, the unique motor has a part integrated to the surface of the tank and a part integrated to the surface of the water contention chamber (25); FIG. 8 shows that the washing chamber (18)is tiltedly placed, preferably around 45°, in such a way that its access is through the upper front part of the washing machine, enabling a better arrangement and a more homogenous distribution of the clothes inside the tank, the unique motor has a part integrated to the surface of the tank (23), a part integrated to the water contention chamber (25).

Furthermore, according to these improvement, the both-way washing chamber (18), which already had a spherical format, can have one or more caps removed from it.

As an illustration, FIGS. 9, 10 and 11 show that the washing chamber (18) is available in several formats: spherical format (FIG. 9); spherical format with one cap removed (FIG. 10); and spherical format with two caps removed (FIG. 11).

These are only a few examples and the Applicant of this patent would like to point out that any amendments introduced to this invention as well as any other applications thereof (in clothes drying machines, for instance) are emcompassed in and protected by this patent.

What is claimed is:

1. A washing machine, comprising:

an electrical motor;

a driving pinion including a first gear which is disposed at one end of the electrical motor;

an arc portion which is connected to the first gear;

a supporting means for supporting the arc portion, the supporting means having an axis, the axis having a second gear at one end thereof, the second gear is linked to the first gear;

a washing chamber supported on a middle point of the arc portion;

a toothed rack which surrounds the washing chamber;

a draining ring for letting water out during centrifugation which is carried out only horizontally; and a hot chamber for an injection of steam or hot air during a drying process;

wherein the first gear receives a circular motion from the motor and allows a 360-degree turn of the washing chamber around the axis fixed to the supporting means; the toothed rack is in contact with the second gear of the axis and allows a 360-degree turn of the washing chamber vertically.

2. A washing machine comprising:

an electrical motor;

an arc portion including a friction wheel;

a washing chamber which is in contact with the friction wheel;

a first toothed rack fixed to a base of the washing machine; and a second toothed rack which totally encompasses the washing chamber;

wherein the electrical motor rotates the arc portion horizontally 360° around an axis of the arc portion, allowing the 360-degree turn of the friction wheel vertically, which is free, in contact with the first toothed rack, the horizontal circular motion of the arc portion is converted into a vertical circular motion of the washing chamber, through a contact of the friction wheel with the first toothed rack; the vertical circular motion is transferred to the washing chamber through the second toothed rack.

3. A washing machine, wherein two-way tilting of a washing chamber is carried out by three electrical motors, a first motor to carry out 360-degree turn around an "X" axis, and second and third motors to carry out 360-degree turn around a "Y" axis, and the second and third motors are supported on an arc portion which sustains the washing chamber, and fixed at a middle point of the washing chamber.

4. The washing machine, according to claim 1, wherein the washing chamber is tiltable in two ways, the two-way tilting is carried out by two motors, a first motor to carry out 360-degree turn around an "X" axis, and a second motor to carry out 360-degree turn around a "Y" axis, the second motor includes a first part fixed to a middle point of a surface of the washing chamber and a second part coupled to an inner surface of the arc portion.

5. The washing machine, according to claim 1, wherein the washing chamber is tiltable in two ways, the two-way tilting is carried out by two motors, a first motor to carry out 360-degree turn around an "X" axis, and a second motor to carry out 360-degree turn around a "Y" axis, the second motor has a first part integrated to a surface of the washing chamber, a second part integrated to the surface of the hot chamber.

6. The washing machine, according to claim 5, wherein the washing chamber is tiltedly placed.

7. The washing machine, according to claim 5, wherein the washing chamber is tiltedly placed around 45°.

8. The washing machine, according to claim 1, wherein the washing chamber has a spherical form.

9. The washing machine, according to claim 8, wherein the washing chamber has a spherical form, with one or more caps being removed.

10. The washing machine, according to claim 3, wherein the washing chamber is tiltedly placed.

11. The washing machine, according to claim 3, wherein the washing chamber is tiltedly placed around 45°.

* * * * *

UNITED STATES PATENT AND TRADEMARK OFFICE

CERTIFICATE OF CORRECTION

PATENT NO. : 6,427,494 B1
DATED : August 6, 2002
INVENTOR(S) : Marcelo Monteiro

It is certified that error appears in the above-identified patent and that said Letters Patent is hereby corrected as shown below:

Title page,
Item [54], delete "INTRODUCED IN WASHING MACHINES" and insert therefor -- WASHING MACHINE CHAMBER --;

Title page,
Item [30], Foreign Application Priority Data, after "Nov 13, 1998 (BR)" delete "003907" and insert therefor -- PI 9806475-4 --.

Column 2,
Line 62, after "both" delete "way" and insert therefor -- ways --

Column 3,
Line 5, after "3" delete "gear" (2nd occurrence)

Signed and Sealed this

Twenty-first Day of October, 2003

JAMES E. ROGAN
*Director of the United States Patent and Trademark Office*